US006217935B1

(12) United States Patent
Hubbell

(10) Patent No.: US 6,217,935 B1
(45) **Date of Patent: *Apr. 17, 2001**

(54) METHOD AND HAND HELD PEN TYPE APPLICATOR FOR APPLYING HAZARDOUS CHEMICALS

(75) Inventor: D. Sterling Hubbell, Riverside, CA (US)

(73) Assignee: Henkel Corporation, Gulph Mills, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/038,033

(22) Filed: Mar. 29, 1993

Related U.S. Application Data

(63) Continuation of application No. 07/796,154, filed on Nov. 22, 1991, now abandoned.

(51) Int. Cl.[7] ..... B05D 1/28

(52) U.S. Cl. ..... 427/142; 427/429; 401/43; 401/198; 401/199

(58) Field of Search ..... 401/43, 198, 199; 427/429, 142

(56) References Cited

U.S. PATENT DOCUMENTS

| | | | | |
|---|---|---|---|---|
| 3,003,181 | * | 10/1961 | Rosenthal | 401/199 |
| 3,195,544 | * | 7/1965 | Politzer et al. | 401/198 |
| 3,688,450 | * | 9/1972 | Brockman | 401/199 |
| 3,713,744 | | 1/1973 | Sims | 401/9 |
| 3,797,706 | | 3/1974 | Mule | 222/187 |
| 4,017,871 | * | 4/1977 | Hubbard | 346/140 R |

(List continued on next page.)

OTHER PUBLICATIONS

Technical Process Bulletin No. 1161, Henkel Surface Technologies, (distributed at least as early as 1990). (No Month Date).

*Primary Examiner*—Katherine A. Bareford
(74) *Attorney, Agent, or Firm*—Wayne C. Jaeschke; Stephen D. Harper

(57) ABSTRACT

A method and applicator for use in applying hazardous chemical solutions to surfaces. The invention employes a pen applicator to apply a measured amount of the hazardous chemical solution to a surface as a dispensing tip is applied to the surface. A typical pen applicator includes a tubular body in which a liquid absorbing material is disposed to hold the hazardous solution. A tip in contact with the reservoir and one end of the tip acts as a wick to draw the solution from the reservoir to the tip, and the other end of the tip is configured to apply the solution to a surface when that end of the tip is placed in contact with the surface. A tip cover is provided to seal the tip and tip-end of the tubular body prevent inadvertent application of the solution and to preserve the shelf life. A cap or sealing member is provided at the end of the body to seal the reservoir. The size of the solution reservoir and the size and shape of the dispensing tip are chosen to provide the appropriate amount of solution to desired area of a surface. In the method of the present invention, the liquid dispensing tip is brought in contact with the surface and is rubbed over the desired area to dispense a controlled amount of the hazardous solution on the desired area of the surface. The applicator eliminates the amount of hazardous waste normally produced in the touch up processes, and reduces the number of process steps and time involved. The applicator is a simple, hand held, self feeding device, and is easily stored, is less messy to use, and requires less work area and process space. The applicator reduces solution waste by up to 99%, and the only waste material thrown away is an expired or empty applicator.

12 Claims, 1 Drawing Sheet

U.S. PATENT DOCUMENTS

| | | | | |
|---|---|---|---|---|
| 4,082,467 | * | 4/1978 | Kaplan | 401/199 |
| 4,133,614 | * | 1/1979 | Baginski et al. | 401/198 |
| 4,218,155 | | 8/1980 | Weidner | 401/132 |
| 4,272,416 | | 6/1981 | Passalenti et al. | 106/14.23 |
| 4,652,163 | | 3/1987 | Karliner et al. | 401/195 |
| 4,712,571 | * | 12/1987 | Remz et al. | 401/199 |
| 4,752,336 | | 6/1988 | Figiel | 106/14.23 |
| 4,909,650 | | 3/1990 | Gilbert | 401/196 |
| 4,973,181 | * | 11/1990 | Jankewitz | 401/199 |
| 5,015,112 | | 5/1991 | Arnold | 401/202 |
| 5,074,455 | * | 12/1991 | Peana et al. | 401/198 |
| 5,702,759 | * | 12/1997 | White et al. | 427/142 |
| 6,048,921 | * | 4/2000 | White et al. | 524/462 |

* cited by examiner

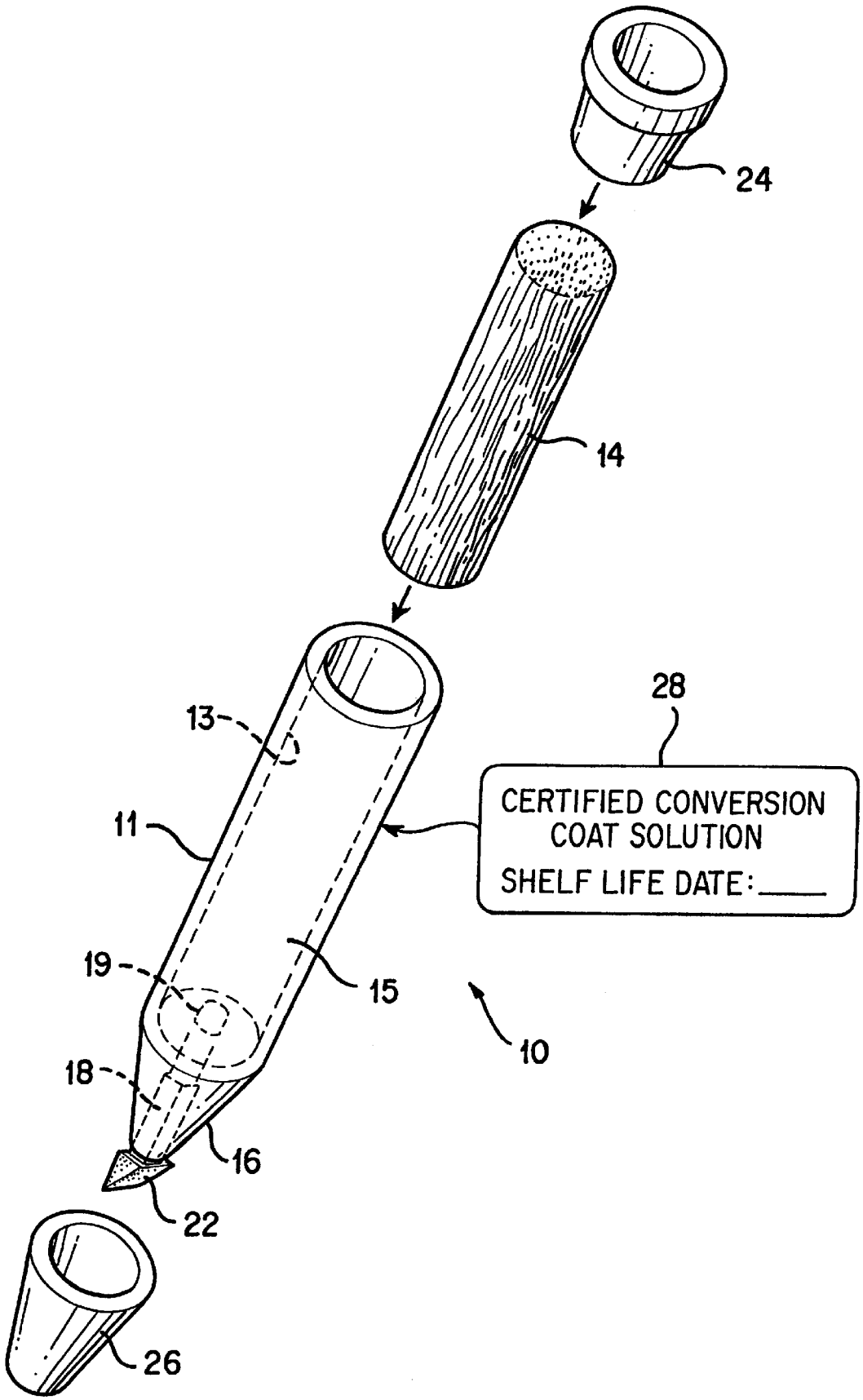
24
14
28
13
CERTIFIED CONVERSION
COAT SOLUTION
SHELF LIFE DATE:____
11
19
15
10
18
16
22
26

METHOD AND HAND HELD PEN TYPE APPLICATOR FOR APPLYING HAZARDOUS CHEMICALS

This is a continuation of application Ser. No. 07/796,154 filed Nov. 22, 1991, now abandoned.

BACKGROUND

The present invention relates to the application of hazardous chemicals, and more particularly, to a method and a hand held pen type applicator for use in applying hazardous chemical solutions to scratched surfaces, and the like, and even more particularly, to such a method and applicator for touching up conversion coated aluminum surfaces.

Typically, aluminum parts for use in commercial and military systems are fabricated, and then their surfaces are chemically treated to prevent corrosion using conventional batch processing techniques. This chemical treatment process is quite important in applications that require electrical and thermal insulation or conductivity, for example. After chemical treatment, however, many parts become scratched during subsequent processing steps, which removes a portion of the chemically treated corrosive protection layer from the surfaces of the parts. Consequently, it becomes necessary to treat the scratched areas to return the surfaces to a condition of complete chemically treated corrosive protection.

Typically, the chemical re-treatment process uses a MIL-C-81706 treating solution, commonly known as certified conversion coat solution. The conventional method of repairing the scratched aluminum surfaces is to obtain a bottle of certified conversion coat solution, and then using cotton balls, Q-tips, rags, or sponges, and the like, rub, or otherwise apply, the conversion coat solution over the scratched areas until the scratch was fully coated with conversion coat solution. In many cases, the shape of the parts creates many problems in applying the conversion coat solution to the surfaces.

The conversion coat solution is a hazardous material, since it contains quantities of chromic acid and cyanide. These conventional procedures typically apply excessive quantities of the conversion coat solution, and often result in spillage of the hazardous solution, creating a hazardous condition in the treatment area. The conventional process is messy, and much of the conversion coat solution is wasted. The cotton balls, Q-tips, rags, or sponges, and the like which are used to apply the conversion coat or clean up the spillage become hazardous waste as a result of their use and thus present disposal problems.

Accordingly, it is an objective of the present invention to provide a method and apparatus that eliminates the above-mentioned problems. Another objective of the present invention is to provide for an environmentally safe method and apparatus to touch up and repair scratched parts with chemical solutions. It is a further objective of the present invention to reduce the repair cycle time in touching up and repairing scratched parts with chemical solutions. It is a specific objective of the present invention to provide for such a method and means for touch up and repair of aluminum parts with conversion coat solution.

SUMMARY OF THE INVENTION

The present invention employes a hand-held pen applicator to apply a measured amount of the hazardous chemical solution to a surface as the solution dispensing tip is applied to the surface. The applicator may be a well-known conventional "felt tip" type marking pen or similar structure which is filled with the hazardous chemical solution rather than a non-hazardous marking fluid. A label is provided on the applicator that identifies the hazardous chemical solution and further denotes the shelf-life of the applicator or solution.

The present invention contemplates that the size of the solution reservoir and the size and shape of the dispensing tip are chosen to provide the appropriate amount of solution to desired area of a surface. For example, a relatively narrow tip may be used to touch up a narrow scratch whereas a broader tip may be used to touch up a scratch having a broader surface area.

A typical pen applicator includes a tubular body in which a liquid absorbing material is disposed. The liquid absorbing material serves as a reservoir for the hazardous coating solution. A solution-dispensing tip is held in contact with the reservoir such that one end of the tip acts as a wick to draw the solution from the reservoir to the tip and the other end of the tip is configured to apply the solution to a surface when that end of the tip is placed in contact with the surface to be touched up or coated. The tubular body and the tip are adapted so that the body holds the wick-end of the tip in contact with the reservoir material and the dispensing-end of the tip is available for application to a surface. A tip cover is provided to seal the tip and tip-end of the tubular body prevent inadvertent application of the solution and to preserve the shelf life. A cap or sealing member is provided at the end of the tubular body to seal the reservoir. The applicator should be made from materials that do not react with the solution.

In accordance with the method of the present invention, the liquid dispensing tip is brought in contact with the surface to be touched up and rubbed over the desired area to dispense a controlled amount of the hazardous solution on the desired area of the surface.

The method of the present invention employs an applicator that uses a felt tip marker containing a MIL-C-81706 certified conversion coat solution or other appropriate chemical solution. The applicator and conversion coat solution (or other solution) are used to touch up small areas and or scratches on conversion coat solution treated aluminum surfaces (or appropriately treated surfaces). The applicator and method of the present invention eliminates the hazardous waste normally produced in the conversion coat touch up process, and substantially reduces the number of process steps and time involved. The method and applicator of the present invention provides hand held, self feeding means for performing conversion coat touch-up. The applicator is easily stored, produces no spillage, and requires less work area and process space for touch up. The present applicator and method reduces solution waste by up to 99%—the only waste material that is thrown away is an expired or empty applicator. The applicator may be refilled or recycled by the user.

The applicator and method of the present invention may be used to treat aluminum parts, and the like, and is specifically used in conjunction with articles that are "inspected and repaired as necessary," known as IRAN articles. The present applicator and method simplifies the conversion coat touch up process and reduces repair cycle time by allowing application of the conversion coat solution regardless of the orientation or location of the scratched surface. In most cases, the applicator allows touch up without disassembly of the article. The present applicator and method may be employed in aluminum pre-paint processes in the automobile, boat and aircraft industries.

The present applicator and method has been tested using a MIL-C-5441 conversion coat solution testing specification. It has been shown that although the present invention applies a minimal amount of conversion coat solution to the surface of the treated parts, the efficacy of the invention is is equivalent to the prior methods. During the chemical reaction process, the solution drys on the surface leaving no wasted conversion coat solution.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which the sole FIGURE of the drawing illustrate a felt tip applicator for applying hazardous chemicals in accordance with the principles of the present invention.

DESCRIPTION OF A PREFERRED EMBODIMENT

Referring to the drawing FIGURE, it shows a representative felt tip applicator 10 for applying hazardous chemical solutions in accordance with the method of the present invention. The applicator 10 is well-suited to the application of certified conversion coat solution, as it is known in the art, and which is disposed within the body of the applicator 10. However, it is to be understood that other chemical solutions for treating aluminum, or other solutions for treating other metals or materials, and the like, may be readily employed according to the present invention. It is further to be understood that the applicator illustrated in the drawing is representative of a suitable applicator and that numerous variations thereof are within the scope of the invention. Consequently, it is to be understood that the present invention is not limited to the application of conversion coat solution and aluminum parts alone.

The representative applicator 10, also referred to as a chemical film touch-up pen, includes a tubular body 11, typically made of a plastic such as butyl phenol epoxy, having a chamber 13 in which an absorbant material 14 is disposed. The absorbant material 14 which may be butyl cellulose acetate with inorganic fillers, serves as a reservoir for a hazardous coating solution 15. One end 16 of the tubular body 11 is adapted, for example by tapering and suitable internal structures, to hold a solution-dispensing tip 18 (which has corresponding cooperating structure). The tubular body 11 maintains one end 19 of the solution dispensing tip 18 in contact with the reservoir 14 such that the tip 18 acts as a wick in to draw the solution 15 from the reservoir to the dispensing end 22 of the tip 18. It will be recognized that the dimensions of the applicator body 11 are variable and are mainly constrained by considerations related to the fact that the applicator 10 is a hand-held instrument and factors related to the specific type of application (i.e., such as the volume of solution 15 that is desired to be contained in the reservoir 14).

The size and shape of the dispensing end 22 of tip 18 is selected to provide an appropriate amount of the solution 15 to a desired area of a surface when the tip 18 is placed in contact with the surface or rubbed upon the desired area. The tip 18, which is commonly referred to as a felt tip, is typically made of nylon or other synthetic material. A tip having an application surface area of approximately one-quarter inch by one-eighth inch is suitable for most touch up problems.

A sealing cap 24 is provided at the opposite end of the body from the applicator tip 18 to seal the absorbant material 14 within the body 11. A tip cover 26 is provided to seal the tip end of the applicator 10 to prevent inadvertent application of the solution 15 and to preserve shelf life.

A label 28, or other indicator, is applied to the outer surface of the applicator 10 denoting the contents of the applicator and any other appropriate information such as certifications, expiration dates, cautionary warnings and the like.

Since the conversion coat solution 15 is a hazardous substance, the applicator is preferably filled by injecting the solution 15 into the absorbant material after the absorbant material has been sealed in the tubular body by the sealing cap 24. The dispensing tip 18 is then inserted into the body 11 of the applicator and brought in contact with the reservoir 14.

It will be recognized that the applicator must be constructed of materials that do not react with the chemical solution 15 that is to be applied.

In operation, the uncovered dispensing tip 18 is placed in contact with the surface to be coated in the same manner that a marking pen is used to mark or highlight something. The solution 15 in the reservoir 14 feeds to the tip 18, as needed, when the tip is placed in contact with or rubbed on the surface.

The applicator 10 and method has been tested using a MIL-C-5541 conversion coat testing specification. It has been shown that the applicator 10 and method applies a minimal amount of conversion coat solution 15 to the surface of the treated parts. During the chemical reaction process, the conversion coat solution 15 drys on the surface leaving substantially no wasted solution 15.

Thus, the present invention eliminates the problems associated with conventional touch-up repair of conversion coat treated aluminum surfaces, and provides for a simple means to touch up and repair scratched parts with chemical solutions. The present invention also reduces the repair cycle time in touching up and repairing scratched parts with chemical solutions, such as conversion coat-treated aluminum.

The applicator 10 reduces solution waste by up to 99%, and the only waste material thrown away is an expired or empty applicator 10. However, the applicator 10 may be recycled for use by disposing of the used absorbing material 14 and tip 18 and replacing them with unused components.

Thus there has been described a felt tip applicator for use in applying hazardous chemicals to scratched surfaces, and more particularly, to a method and applicator that may be used in touching up conversion coated aluminum surfaces. It is to be understood that the above-described embodiment is merely illustrative of some of the many specific embodiments which represent applications of the principles of the present invention. Clearly, numerous and other arrangements can be readily devised by those skilled in the art without departing from the scope of the invention.

What is claimed is:

1. A method of repairing a damaged portion of a conversion coated metal surface comprising the steps of:

a) providing an applicator having a reservoir and a liquid dispensing tip, wherein said reservoir contains a quantity of a conversion coat solution;

b) contacting said damaged portion of said conversion coated metal surface with said liquid dispensing tip; and c) dispensing a controlled amount of said conversion coat solution from said reservoir through said liquid dispensing tip onto said damaged portion of said conversion coated metal surface.

2. The method of claim 1 wherein said conversion coat solution comprises chromic acid.

3. The method of claim 2 wherein said conversion coat solution further comprises cyanide.

4. The method of claim 1 wherein a liquid absorbent material is disposed within said reservoir.

5. The method of claim 4 wherein said liquid absorbent material comprises butyl cellulose acetate.

6. The method of claim 1 wherein said liquid dispensing tip comprises nylon.

7. The method of claim 1 wherein said liquid dispensing tip comprises a synthetic material.

8. The method of claim 1 wherein the metal of said conversion coated metal surfaces is aluminum.

9. The method of claim 8, wherein said conversion coated metal surface is for use in construction of an aircraft.

10. The method of claim 1 wherein said applicator further comprises a tip cover removably attached to said liquid dispensing tip.

11. A method of repairing a damaged portion of a conversion coated aluminum surface comprising the steps of:

a) providing an applicator having a sealed reservoir containing an absorbent material comprising butyl cellulose acetate, a liquid dispensing tip comprising a synthetic material, and a tip cover removably attached to said liquid dispensing tip, wherein said reservoir contains a quantity of a chromic acid and cyanide conversion coat solution;

b) removing said tip cover from said liquid dispensing tip to enable the dispensing of said chromic acid and cyanide conversion coat solution;

c) contacting said damaged portion of said conversion coated aluminum surface with said liquid dispensing tip and dispensing a controlled amount of said chromic acid and cyanide conversion coat solution from said reservoir through said liquid dispensing tip onto said conversion coated aluminum surface; and d) replacing said tip cover onto said liquid dispensing tip to prevent accidental dispensing of said chromic acid and cyanide conversion coat solution.

12. The method of claim 11 wherein the applicator has a body and wherein the body of said applicator is butyl phenol epoxy.

* * * * *